US006994431B2

(12) United States Patent
Kitabatake et al.

(10) Patent No.: US 6,994,431 B2
(45) Date of Patent: Feb. 7, 2006

(54) LIQUID CONTAINER AND RECORDING APPARATUS

(75) Inventors: Kenji Kitabatake, Kawasaki (JP); Keisuke Matsuo, Yokohama (JP); Hiromasa Anma, Kawasaki (JP); Hajime Yamamoto, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 10/735,753

(22) Filed: Dec. 16, 2003

(65) Prior Publication Data

US 2004/0150705 A1 Aug. 5, 2004

(30) Foreign Application Priority Data

Dec. 16, 2002 (JP) ..... 2002-363624
Dec. 12, 2003 (JP) ..... 2003-414856

(51) Int. Cl.
*B41J 2/175* (2006.01)

(52) U.S. Cl. ..... 347/86

(58) Field of Classification Search ..... 347/19, 347/85, 86

See application file for complete search history.

(56) References Cited

U.S. PATENT DOCUMENTS

| | | | | |
|---|---|---|---|---|
| 5,049,898 | A * | 9/1991 | Arthur et al. | 347/19 |
| 5,365,312 | A | 11/1994 | Hillmann et al. | 355/206 |
| 5,616,929 | A | 4/1997 | Hara | 250/573 |
| 5,699,091 | A | 12/1997 | Bullock et al. | 347/19 |
| 5,737,300 | A * | 4/1998 | Ota et al. | 369/112.24 |
| 6,547,363 | B1 * | 4/2003 | Shinada et al. | 347/19 |
| 2002/0109761 | A1 | 8/2002 | Shimizu et al. | 347/86 |
| 2003/0227501 | A1 | 12/2003 | Hatasa et al. | 347/19 |
| 2003/0234844 | A1 * | 12/2003 | Yamamoto et al. | 347/86 |

FOREIGN PATENT DOCUMENTS

| | | |
|---|---|---|
| JP | 2-102062 | 4/1990 |
| JP | 7-218321 | 8/1995 |
| JP | 9-309213 | 12/1997 |
| JP | 2752402 | 5/1998 |

* cited by examiner

*Primary Examiner*—Huan Tran
(74) *Attorney, Agent, or Firm*—Fitzpatrick, Cella, Harper & Scinto

(57) ABSTRACT

A liquid container containing ink, which is detachably mountable to a carriage, the improvement residing in the provision of an optical medium to which information is writable using visible light and from which the information is readable.

5 Claims, 8 Drawing Sheets

LIQUID CONTAINER AND RECORDING APPARATUS

FIELD OF THE INVENTION AND RELATED ART

The present invention relates to a liquid container for storing liquid, for example, ink, etc. In particular, it relates to a liquid container to be employed by a recording apparatus in order to record an image or the like on recording medium, for example, recording paper, by ejecting ink onto the recording medium. It also relates to a recording apparatus employing such a liquid container.

Generally, a recording head with which an ink jet recording apparatus is provided has ink ejection orifices from which droplets of ink are ejected. It records letters, pictures, etc., on recording medium by ejecting droplets of ink onto the recording medium while being moved relative to the recording medium in a manner to scan the recording medium. More specifically, a recording head is mounted on a carriage, which is reciprocally moved following a predetermined path (primary scan direction). After each reciprocal movement of the carriage in the primary scanning direction recording medium is moved a predetermined distance in the direction (secondary scan direction) perpendicular to the moving direction of the carriage. Ordinarily, a recording head is structured so that it can be removably mounted on a carriage, or so that an ink container for storing the ink to be supplied to a recording head is structured so that it can be removably connected to a recording head.

It has been a common practice to provide an ink jet recording apparatus with an ink remainder amount detecting means. That is, a sensor is attached to the main assembly of an ink jet recording apparatus, and as a carriage is moved, the amount of the ink remainder in an ink container is automatically detected by the sensor, and a user is warned if it is detected that the amount of the ink in the ink container has reduced to a critical value or below. There are various ink remainder amount detecting means. For example, some ink remainder amount detecting means comprise a pair of electrodes placed in an ink container so that the presence or absence of ink can be detected by measuring the amount of the electrical conductivity between the pair of electrodes, whereas others optically detect the ejected droplets of ink.

As for an ink jet recording head and an ink container therefor, in accordance with the prior arts, there are those equipped with a means for optically detecting the amount of the ink therein (which are disclosed in Patent Documents 1 and 2, for example). However, it is only with predetermined intervals that these detecting methods can detect the amount of ink remainder; it is very difficult to continuously detect the amount of ink remainder with the use of these detecting methods. In other words, with the use of these detecting methods, it is difficult to show the amount of the ink remainder in an ink container in the analog fashion.

Thus, it is common practice to use a method, in which the total amount of the liquid ejected in the form of a droplet from a recording head is counted, and the amount of the ink remaining in an ink container is calculated based on the counted total amount of the ink ejected from the ink container, in conjunction with a method capable of displaying the amount of the ink remaining in the ink container in the analog fashion.

However, many ink containers are structured so that they can be removably mounted on a carriage, as described above. Thus, there is the possibility that as a given ink container is replaced with another ink container, the information, that is, the amount of the ink remainder, which has been detected, and stored, by the main assembly of an ink jet recording apparatus from which the given ink container has just been removed, will contradict with the amount of the ink in the replacement ink container.

For example, some ink jet recording apparatuses are systemized in such a way that, as a partially emptied ink container is replaced with another ink container, the ink container replacement operation is detected by a sensor, and the information on the main assembly side of an ink jet recording apparatus regarding the ink remainder level is reset. In other words, in the case of these recording apparatuses, even if the replacement ink container is not a brand-new one, that is, a partially empty one, the system treats the replacement ink container as a brand-new one, resetting thereby the information regarding the ink remainder level. As a result, the actual amount of the ink in the replacement ink container does not coincide with the displayed amount of ink remainder.

Thus, it has been proposed to provide an ink container with a memory element or the like as information storage so that the amount of the ink remaining in an ink container can be stored in the memory element of the ink container itself, in order to make it possible to accurately display the ink remainder level even if a given partially empty ink container is replaced with an ink container which is not full (for example, Patent Documents 3 and 4):

Patent Document 1: Japanese Laid-open Patent Application 2-102062

Patent Document 2: Japanese Laid-open Patent Application 7-218321

Patent Document 3: Japanese Laid-open Patent Application 9-309213

Patent Document 4: Japanese Patent 2752402.

However, the ink containers in accordance with the prior arts, disclosed in the above listed documents have a problem. That is, if they are systemized so that information is electrically read from, or written into, their memory elements, for example, a RAM (Random-Access Memory) or the like, the electrical connector portions of the memories are sometimes deteriorated due to the repetition of the mounting or removal of the ink containers, and/or the adhesion of the ink splashes from the recording heads (Patent Documents 3 and 4).

In addition, the information having been electrically written into the memory elements cannot be visually confirmed from outside, being it therefore impossible for a user to find the ink remainder levels of the given ink containers from the ink containers themselves.

SUMMARY OF THE INVENTION

Thus, the primary object of the present invention is to provide a more reliable liquid container than a liquid container in accordance with the prior art, in that information can be more reliably written into, or read from the memory element of the ink container, and also so that the information, for example, the amount of the ink remainder in the ink container, in the memory element of the ink container can be obtained even when the ink container is not in connection with the main assembly of an image forming apparatus.

According to one of the characteristic aspects of the present invention for achieving the above object, a liquid container for internally storing liquid therein and removably mountable on the carriage of an ink jet recording apparatus is provided with an optical storage medium into which information can be written with the use of visible light, and from which information can be read with the use of visible light. In the case of a liquid container structured as described above, information is optically written into, or read from, the optical storage medium, assuring that the electrical contact failure, for example, at the electrical connectors, is prevented. Therefore, the liquid container is more reliable in terms of the operation in which information is written into, or read from, the memory medium of the liquid container. Further, the optical storage medium is disposed in the recess, or opening, of the liquid container, preventing thereby dust, liquid, etc., from adhering to the optical storage medium, further improving the ink container in terms of the reliability with information is written into the optical storage medium, or read therefrom.

According to another characteristic aspect of the present invention, at least a part of the information in the optical storage medium is visible as visible information, making it easier to confirm the information such as the amount of ink remainder directly from the ink container itself.

According to another characteristic aspect of the present invention, the direction in which an ink container is mounted onto a carriage is roughly perpendicular to the direction in which the carriage is primarily moved, and the direction in which information is recorded in the optical storage medium is roughly perpendicular to the direction in which the ink container is mounted onto the carriage. Therefore, even if a portion, or portions, of the information in the optical storage medium cannot be read due to the damages to the optical storage medium, the information read from the optical storage medium can be compensated for, for the missing portions, further improving the ink container in terms of the reliability of the information read from the optical storage medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred concrete embodiments of the present invention will be described with reference to the appended drawings.

(Embodiment 1)

Figure 1:
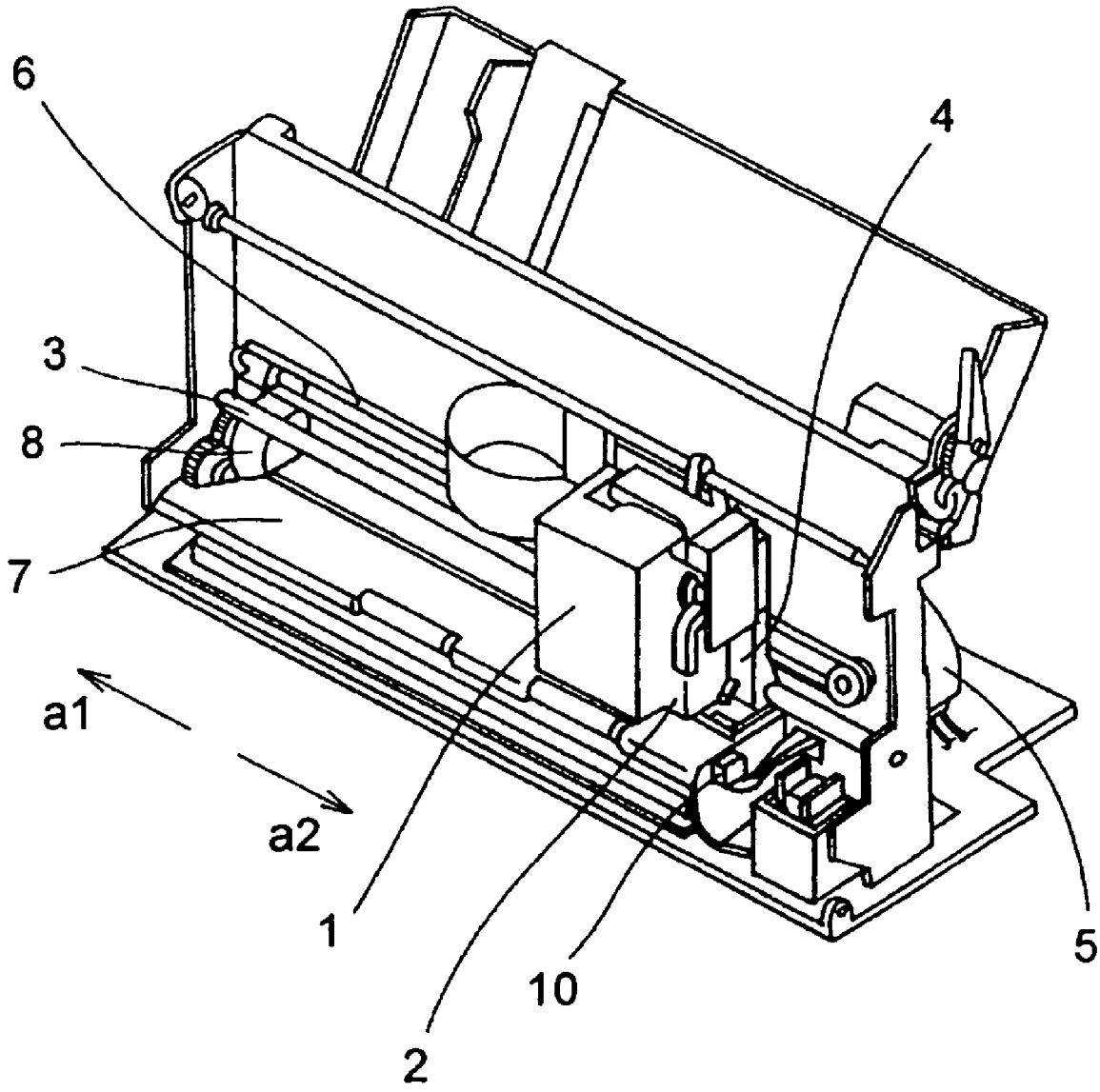
FIG. 1 is a perspective view of the printer in the first embodiment of the present invention.

FIG. 1 is a perspective view of the printer in the first embodiment of the present invention, into which an ink container in accordance with the present invention is mounted. As shown in FIG. 1, the recording head 2 in this printer is connected to the ink container 1 for supplying the recording head 2 with ink. In FIG. 1, the recording head 2 is mounted on the carriage 4, being positioned so that ink will be ejected downward in the drawing. An image is recorded on recording medium (unshown), for example, a piece of recording paper or the like, by ejecting droplets of ink from the recording head 2 while moving the carriage 4 along the guide shaft 3. The carriage 4 is reciprocally moved in the primary direction, that is, the direction indicated by a arrow mark a or the direction indicated by an arrow mark a2, in the drawing, through the timing belt 6, by means of rotationally driving the carriage motor 5. Each time the movement of the carriage 4 (recording head 2) in the primary direction is completed, the actual recording operation is briefly interrupted, and the recording medium on the platen 7 is conveyed a predetermined distance by rotationally driving the recording medium conveyance motor 8. Then, the actual recording operation is restarted to complete the next segment of the recording operation, the length of which corresponds to the width of the recording medium.

Figure 9:
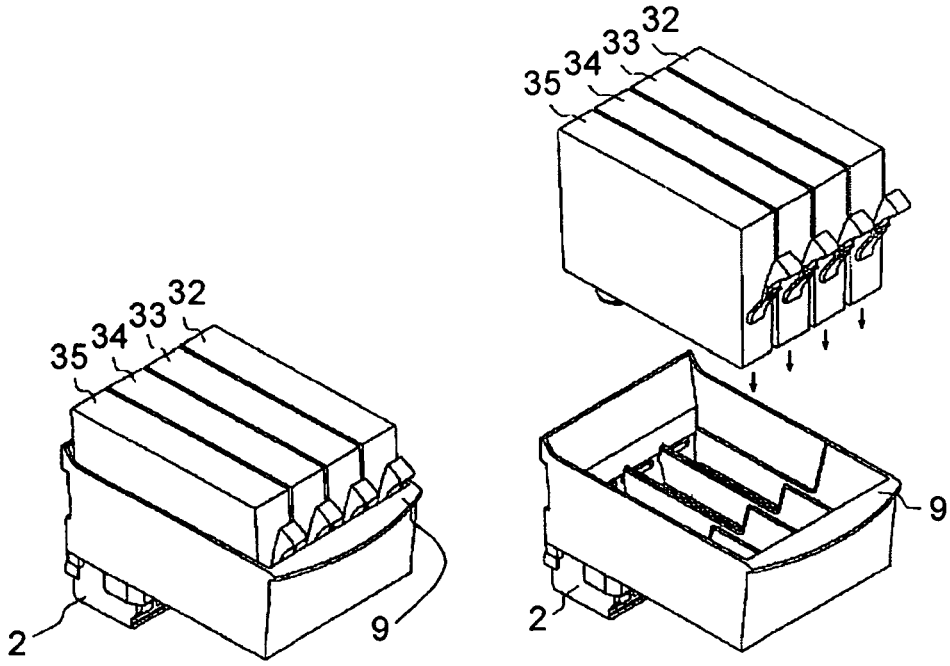
FIG. 9 is a perspective view of the combination of the head holder and ink containers, in the first embodiment, showing how the ink containers are mounted into the head holder.
Figure 10:
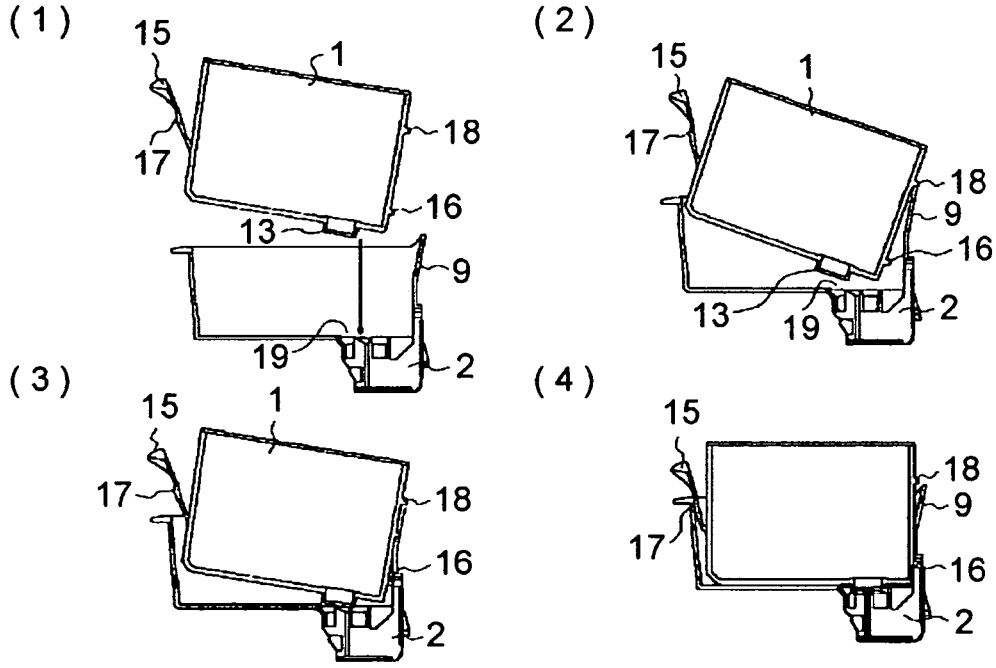
FIG. 10 is a sectional view of the combination of the head holder and ink containers, in the first embodiment of the present invention, showing how the ink containers are mounted into the head holder.

FIG. 9 is a perspective view of the combination of the ink containers and head holder, in accordance with the present invention, showing how the ink containers are mounted into the head holder. FIG. 10 is a sectional view of the combination of the ink containers in accordance with the present invention and head holder, in accordance with the present invention, showing how the ink containers are mounted into the head holder. The recording portion in FIG. 9 comprises a head holder for holding an ink container, and the recording head 2 from which ink is ejected. In this drawing, there are four ink containers Bk32, C33, M34, and Y35, which contain black, cyan, magenta, and yellow inks, respectively, and which are mounted on the head holder 9 to supply the recording head 2 with the four inks different in color.

Figure 2:
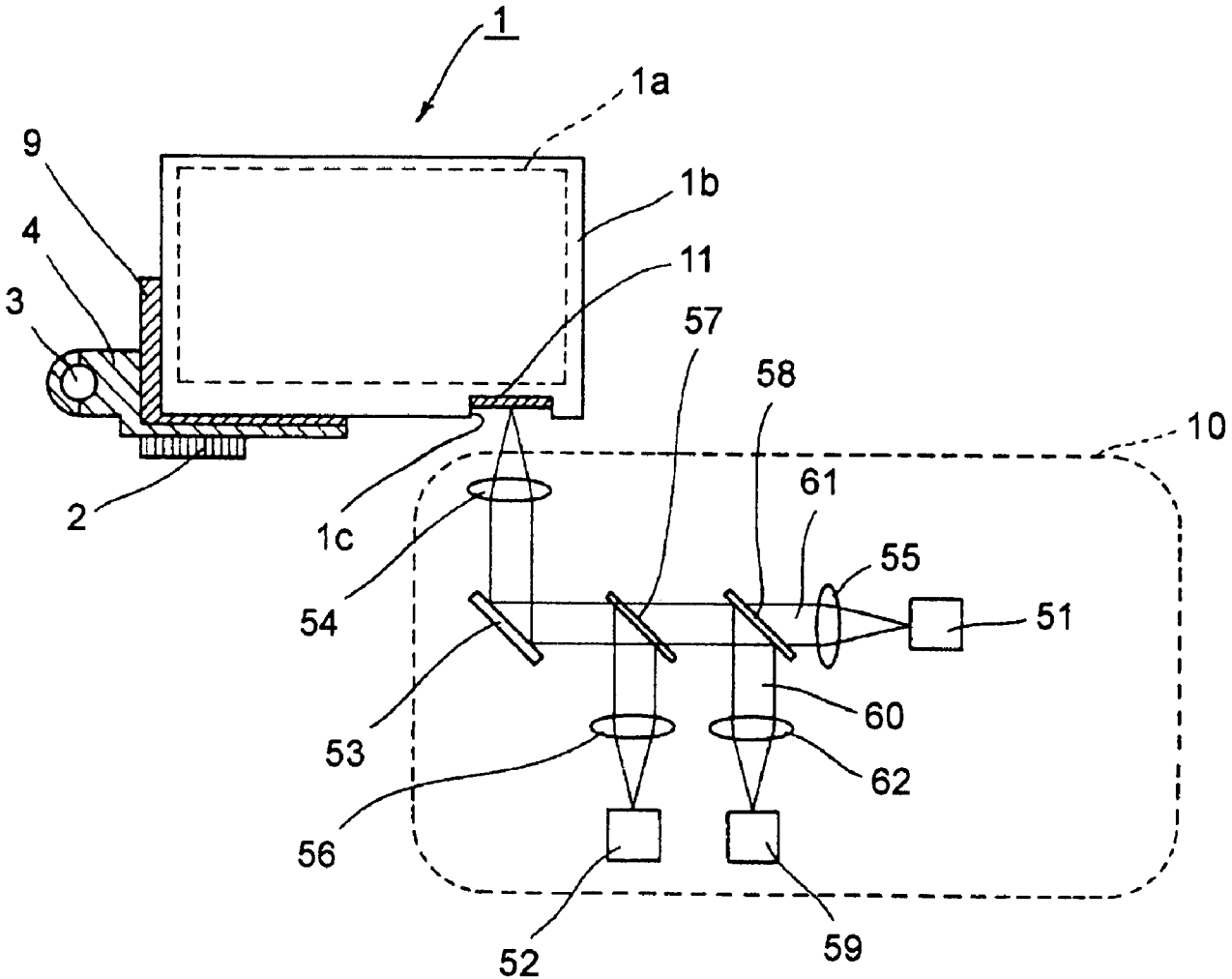
FIG. 2 is a schematic side view of the essential portion of the printer in FIG. 1.

FIG. 10(1)–FIG. 10(4) shows the steps through which each of the ink containers is mounted onto the head holder. The ink container 1 is provided with a first claw 16, a third claw 18, a latching lever 15, and a second claw 17. The first and third claws 16 and 18 are on the front side (right side in drawing), and the latch lever 15 and second claw 17 are on the rear side (left side in drawing). The second claw 7 is an integral part of the latch level 15. The ink container 1 is also provided with an ink outlet 13 for supplying the recording head with ink. The ink outlet 13 is on the bottom surface (bottom side in drawing) of the ink container 1. The head holder 9 is provided with a supply tube 19 for delivering ink to the recording head 2. The position of the supply tube 19 corresponds to that of the ink outlet 13 of the ink container 1. FIG. 10(1) shows the first step for mounting the ink container onto the head holder 9. A user is to mount the ink container onto the head holder 9 from diagonally above the front side (left side in drawing) of the head holder 9. FIG. 10(2) shows the next step, in which the third claw 18 fits into the hole of the head holder 9, being fixed in position relative to the head holder 9. The next step is shown in FIG. 10(3), in which the ink container 1 is to be pressed, on the rear (left side in drawing) portion of the top surface, in order to cause the ink container to rotate about the third claw 18. Then, in the next step shown in FIG. 10(4), the first claw 16, and the second claw 17 of the latch lever 15, engage with the head holder 9, completing the mounting of the ink container 1 onto the head holder 9. As will be evident from the above description, the general direction in which the ink container 1 is mounted into the head holder 9 is perpendicular to the primary direction in which the carriage 4 of the printer is moved. FIG. 2 is a schematic side view or the essential portion of the printer, inclusive of the above described head holder and ink container. As shown in FIG. 2, the ink container 1 is removably mounted in the head holder 9 integral with the recording head 2. The head holder 9 is removably mounted on the carriage 4, being thereby solidly supported by the carriage 4. The ink container 1 comprises an ink container proper 1*a* in which ink is stored, and a housing 1*b* which covers the ink container proper 1*a*. The housing 1*b* of the ink container 1 is provided with a recess 1*c*, which is in the bottom portion of the housing 1*b*, opening in the direction to face the recording medium as the recording medium is conveyed. Within this recess 1*c*, the optical storage medium 11 into which information such as the amount of the ink remainder in the ink container 1, is written, or from which the information is read, is disposed.

Also referring to FIG. 2, the printer is provided with the optical portion 10 for writing information into the optical storage medium 11 of the ink container, or reading information from the optical storage medium 11. This optical portion 10 comprises: an information display power source 51 which emits a beam of laser light for reading the information in the optical storage medium 10; an information recording power source which emits a beam of laser light 60 used for writing information into the optical storage medium 11; and a light reception sensor 52 which catches the light reflected by the optical storage medium 11. The information display light source 51 and information recording light source 59 both have a semiconductor diode which emits laser light. The light reception sensor 52 has a photodiode.

The information recording beam of laser light 60 emitted from the information recording light source 59 is converted into parallel rays by the collimator lens 62. Then, the parallel rays are reflected by a half-mirror 58, and transmitted through a half-mirror 57. After being transmitted through the half-mirror 57, the parallel rays are reflected (deflected) by a mirror 53, and are made to converge on the optical storage medium 11 of the ink container 1.

Figure 3:
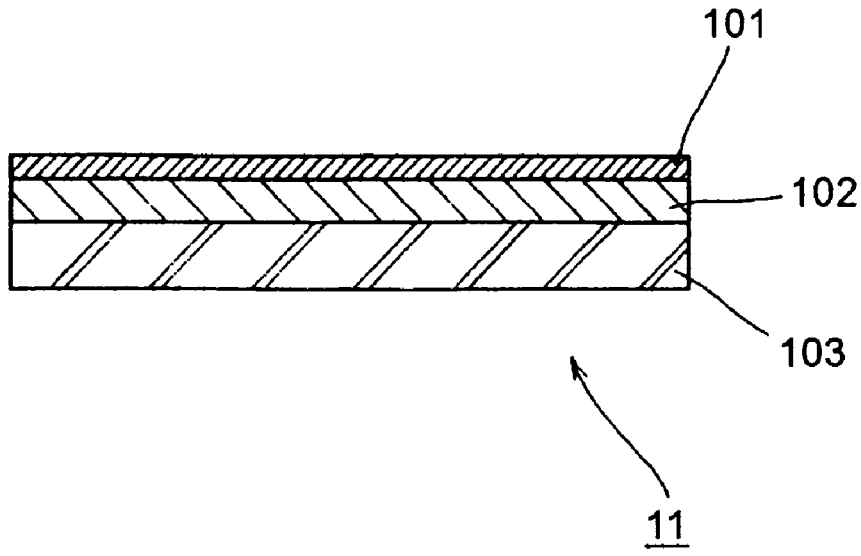
FIG. 3 is a sectional view of the optical storage medium of the ink container of the printer in FIG. 1.
Figure 4:
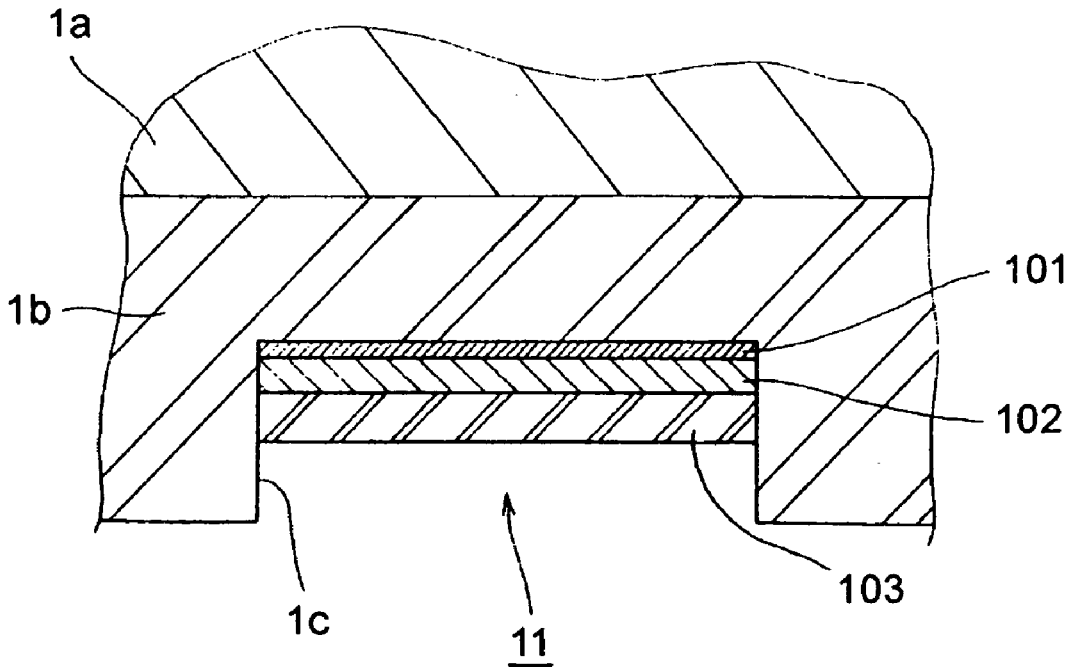
FIG. 4 is a sectional view of the optical storage medium attached to the ink container.

FIG. 3 is a sectional view of the optical storage medium 11, and FIG. 4 is a sectional view of the recess 1*c* portion of the bottom wall of the ink container 1, and the optical storage medium 11 attached to the bottom surface of the recess 1*c*. As shown in FIGS. 3 and 4, the optical storage medium 11 has a substrate 103, a colored film 102, and a reflective film 101. The colored film 102 is formed on the substrate 103, and the reflective film 101 is formed on the colored film 102. The substrate 103 is formed of a transparent resin material such as polycarbonate. As the reflective film 101, aluminum is vapor deposited on the substrate 103. As the material for the colored film 102, copper (II) phthalocyanine is used. The optical storage medium 11 is bonded to the bottom surface of the recess 1*c*, with the reflective film 101 facing the bottom surface of the recess 1*c*, with the use of adhesive or the like.

Therefore, the recording beam of laser light 60 condensed by an object lens 54 enters the optical storage medium 11 from the substrate 103 side, and is condensed on the colored film 102, being absorbed thereby. As the colored film 102 absorbs the condensed information recording laser beam 60, it is melted by the laser beam 60. As the colored film 102 is melted, the substrate 103, which is in contact with the colored film 102, is also heated. As a result, the temperature of the substrate 103 reaches its glass transition point, at which the substrate 103 softens. At this temperature, the coloring material in the color film 102 decomposes, putting pressure on the interface. Consequently, the coloring agent mixes with the substrate material, at the interface, resulting in the formation of a pit at the interface. In other words, an optional number of pits can be formed in a single (in this embodiment) or multiple straight lines in the optical storage medium, by controlling the output of the information recording light power source 59 while moving the carriage 4 in the predetermined direction (primary direction); in other words, information can be written into the optical storage medium 11. Further, if such a structural arrangement is made that the entirety of the optical portion can be moved with the use of a servomotor or the like in the direction perpendicular to the moving direction of the carriage, information can be recorded in two or more lines in the optical storage medium 11, by controlling the position of the carriage 4 at the end of the movement of the carriage 4 in the primary direction, corresponding to a single line of recording.

On the other hand, the information display laser light 61 emitted from the information display light source 51 is converted into parallel rays, which are transmitted through the half-mirrors 58 and 57, and are reflected (deflected) by the reflective mirror 53. Then, the parallel rays are condensed onto the optical storage medium 11 of the ink container 1 by the object lens 54, and are reflected by the optical storage medium 11 (reflective film 101). After being reflected by the optical storage medium 11, the rays are reflected (deflected) by the half-mirrors 53 and 57, being thereby projected onto the light reception sensor 52 through the collimator lens 56.

The pits formed during the recording are lower in refractive index than their adjacencies. Thus, the information encoded, in the form of a line or lines of pits, in the optical storage medium 11 can be read by detecting the difference in refractive index between the points of the recording area of the optical storage medium 11, which have a pit, and those which do not have a pit, while moving the carriage 4 in the primary scanning direction. Incidentally, as long as it is assured that the difference in refractive index between a point with a pit (which colored film 103 forms) and a point without a pit is large enough to be detected, it is unnecessary to provide the optical storage medium 11 with the reflective film 101.

Further, the optical portion may be enabled to be moved in entirety in the direction perpendicular to the primary scanning direction, with the use of a servomotor or the like, in the printer, as described above, so that the optical portion can be controlled in position to compensate for the minute deviation in the ink container position, which occurs each time an ink container is mounted. More specifically, the optical portion can be controlled in position by detecting where the pits have been formed in the optical storage medium 11, while moving the carriage 4 in the direction perpendicular to the primary scanning direction by a servomotor after placing the optical portion directly below the optical storage medium 11 by moving the carriage 4.

In the case of the structural arrangement described above, the optical storage medium 11 and ink container 1 are made structurally independent from each other. However, they may be structurally integral as will be described next. That is, the optical storage medium 11 may be an integral part of the ink container proper, or the housing thereof. In such a case, the optical storage medium 11 is structured as an integral part or the ink container 1. This optical storage medium 11 is the same as that structured as described above. Therefore, the components of the optical storage medium 11 identical to the counterparts in the above described optical storage medium 11 will be given the identical referential symbols as those given to the counterparts, one for one, and will not be described at this time.

Figure 5:
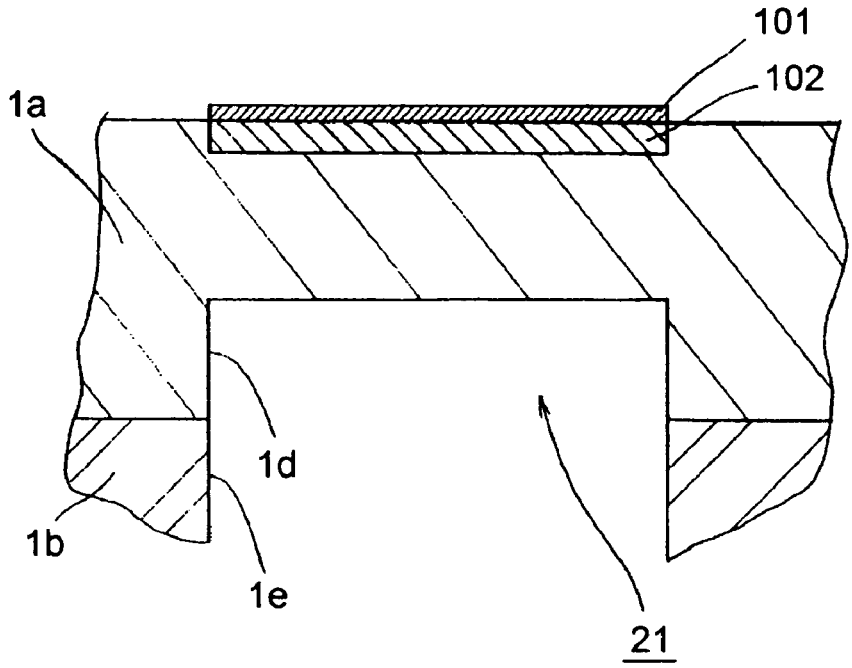
FIG. 5 is a sectional view of the optical storage medium integral with the ink container.

Referring to FIG. 5, the optical storage medium 21 is provided with a colored film 102 and a reflective film 101. The colored film 102 is on the inward side of the colored film 102, with respect to the ink container proper 1*a*, and the reflective film 101 is formed on the colored film 102, on the outward side with respect to the ink container proper 1*a*.

More specifically, the colored film 102 is directly formed on the bottom surface of a recess in the outward surface of the ink container proper 1*a*, and the reflective film 101 is formed by vapor deposition, on the colored film 102, on the outward side with respect to the ink container proper 1*a*. The reflective film 101 is also made to function as a protective film for protecting the colored film 102, which is on the inward side of the reflective film 101, with respect to the ink container proper 1*a*.

In this case, a part of the ink container proper 1*a* of the ink container 1 functions as substrate, like the substrate 103 of the above described optical storage medium 11. Therefore, the ink container proper 1*a* is desired to be formed of a material, such as amorphous cyclic poly olefin, compatible with the material for the colored film 102.

The ink container proper 1*a* is also provided with a recess 1*d*, which corresponds in position to the colored film 102 and reflective film 103; the recess 1*d* is provided for the adjustment of the thickness of the wall of the ink container proper 1*a*, across the portion corresponding to the films 102 and 103, so that the portion of the wall of the ink container proper 1*a* corresponding to the films 102 and 103 will display roughly the same degree of transparency as that of the substrate 103 in the above described optical storage medium. Further, the housing 1*b* of this ink container 1 is provided with an opening 1*e* for allowing a beam of laser light to be projected onto the optical storage medium 21.

Not only can information be written into, or read from, the above described optical storage medium 11 after the mounting of the ink container 1 into a printer, but also while the ink container 1 is manufactured.

Next, the information to be recorded in the optical storage medium 11 will be described. Prior to the mounting of a brand-new ink container into a printer, the information, or the amount of the ink remainder in the ink container, in the optical storage medium 11 of the brand-new ink container, is a value of the maximum recordable amount of the ink fillable into the ink container, and it is written into the optical storage medium 11 during ink container manufacture. Incidentally, the so-called amount of ink usage is the sum of the total amount of the ink ejected by the recording head, and the total amount of the ink suctioned away by the recording performance recovery mechanism in order to restore the recording head in recording properties. Thus, the information, or the amount of the ink remaining in the ink container at a given point in time, is obtained by subtracting the amount of ink usage from the information, or the initial amount of the ink in the ink container, in the optical storage medium 11. This information can be displayed as the amount of the ink remainder to a user, and is written into the ink container.

By practicing the above described routine, the relationship between the information retained on the main assembly side of a printer, regarding the amount of the ink remainder in an ink container, and the amount of the ink remaining in the ink container having just been mounted as a replacement ink container, can be properly maintained. In other words, even if a partially emptied ink container is removed from the carriage of a printer, and is remounted onto the carriage after the printer is operated with another ink container, the amount of the ink remainder in this partially emptied ink container can be accurately registered on the main assembly side of the printer. This embodiment of the present invention was described with reference to the amount of the ink remainder in an ink container. However, the information to be recorded in the recording medium of an ink container may be the amount of the ink injected into an ink container, amount of the ink consumed from an ink container, etc., because the amount of the ink remainder in an ink container can be calculated from the amount of the ink injected into the ink container during the manufacture of the ink container and the amount of the ink consumed from the ink container.

Further, the information to be recorded in the optical storage medium 11 of the ink container 1 may be the date when the ink container was used for the first time. In this case, the date when the ink container, in the brand-new condition, was mounted in a printer for the first time is recorded, as the initial usage date for the ink container 11, into the optical storage medium 11 of the ink container 1. Then, each time the ink container 1 is used, the optical portion 10 of a printer reads the initial usage date of the ink container 1, calculates the number of days having passed since the initial usage date, and subtracts an estimated value equivalent to the amount of the ink reduced by natural evaporation since the initial usage date. Therefore, the amount of the ink remainder displayed on an unshown display panel, monitor, etc., is more accurate.

Generally, ink contains various solvents, which are more than likely to naturally evaporate. Thus, the ratios of the solvents in ink change with the elapse of time, making thereby the recording head 2 unstable in ejection performance, making thereby it difficult to record an image at a desirable level of quality. In consideration of this fact, an ink container may be structured so that a message can be displayed to a user, suggesting that the ink container in a printer should be replaced with another ink container, when it is determined that the number of days having elapsed since the initial usage date of the ink container in the printer has exceed a predetermined value.

Further, the information to be recorded in the optical storage medium 11 may be the production date of an ink container. With the production date of a given ink container recorded in the optical storage medium 11 of the ink container during the production of the ink container, it is possible for the main assembly of a printer to calculate the number of days having elapsed since the manufacture of the ink container, calculate the amount of the ink having reduced due to natural evaporation since the manufacture of the ink container, and subtract the calculated amount of the ink reduction from the information, or the amount of the ink remainder, in the ink container. With this arrangement, the displayed amount of the ink remainder in the ink container is more accurate. Also in this case, the ink container may structured so that a message can be displayed to a user, suggesting that the ink container in a printer should be replaced with another ink container, when it is determined that the number of days having elapsed since the production of the ink container in the printer has exceed a predetermined value.

Moreover, the color of the ink in a given ink container may be recorded in the optical storage medium 11. With the color of the ink in a given ink container recorded in the optical storage medium 11 of the ink container during the production of the ink container, it is possible for the main assembly of a printer to read the information, or the color of the ink in the ink container, in the optical storage medium 11, in order to determine whether or not the ink container having just been mounted in the printer is the right one. Therefore, it is possible to prevent ink of the wrong color from being fed into a recording head 2.

Figure 6:
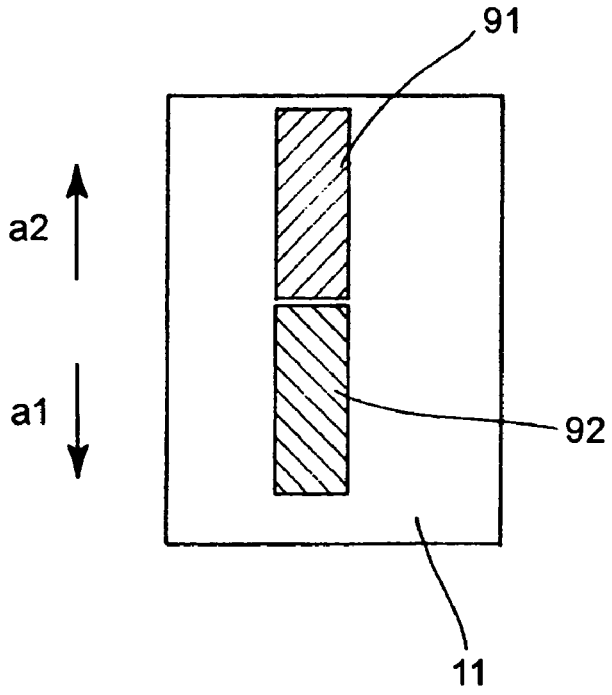
FIG. 6 is a schematic front view of the optical storage medium.

Next, one of the methods for writing information into an optical storage medium 11 will be described. Referring to FIG. 6, the optical storage medium 11 is provided with a data-writable region 91 into which primary information, such as the amount of the ink remainder in an ink container, described above, is written, and an allocation table-writable region 92 into which secondary information, that is, the location of the primary information, is written. With this arrangement, when information is added to the primary information which was written in advance in the optical storage medium 11, the additional information is written into the regions subsequent to the region into which the primary information was written last time. Therefore, the secondary information, that is, the location of the data-writable region 91 into which the primary information was written last time, is in the allocation table-writable region 92, making it possible to write additional primary information into the location subsequent to the location into which information was written last time. For example, when the end of the content of the main or primary information is blank, that is, no bit is formed there, the primary information is read without the secondary or subordinate information. If the additional information is written to the end of the content, the blank information is not recognized as a piece of information, that is, the blank information is destroyed. According to this embodiment, however, the additional information is written on the basis of the secondary information, the primary information can be written without overwriting the blank information. The position of the end of the information added to the primary information is rewritten to the secondary information, so that the position where the next information is to be written can be recorded. The data writing region 91 and the allocation table writing region 92 may be preformed, during manufacturing, as the information of a start positon or the like of the information writing. In this embodiment, the writing method is as described above, but another method is usable.

Figure 7:
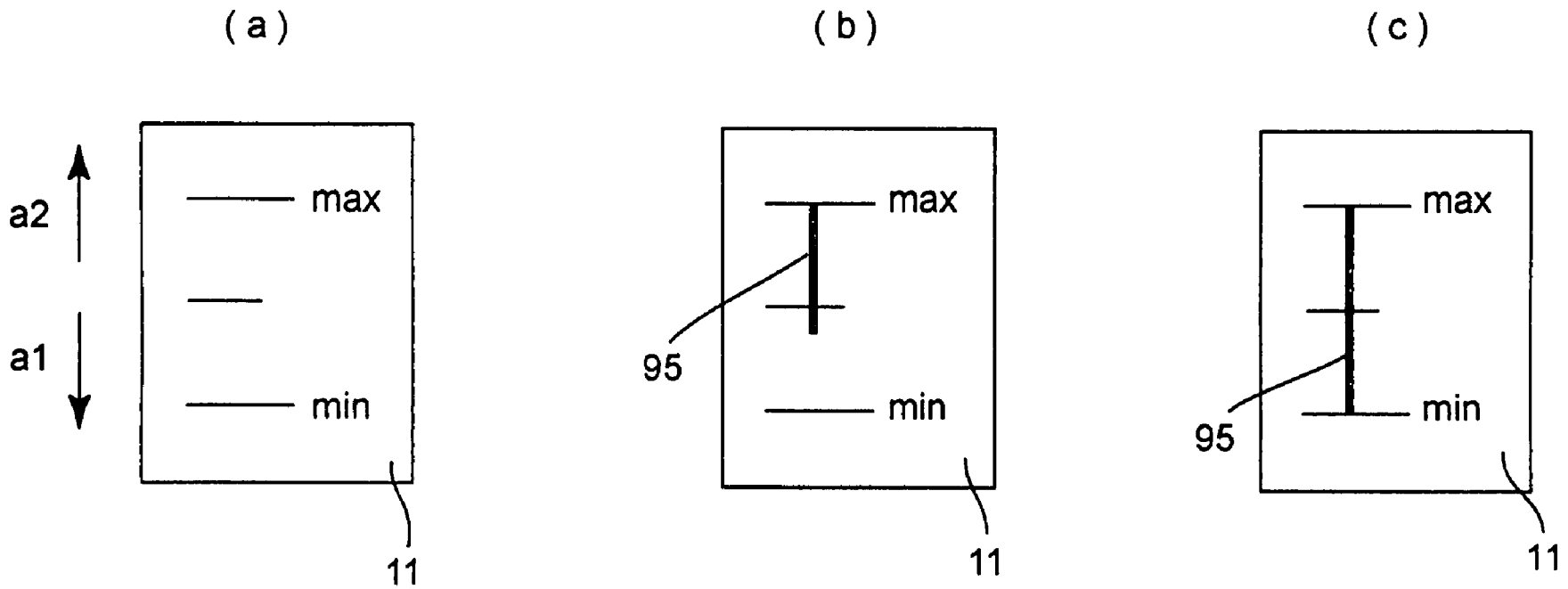
FIG. 7 is a schematic drawing for showing how it is made possible for the amount of the ink remaining in an ink container, stored in the optical storage means, to be visually confirmed.

Referring to FIG. 7(*a*), the ink container 1 may be provided with an ink level gauge (which displays amount of ink remainder within range between max. and min. in FIG. 7(*a*)) for showing the amount of the ink remainder in the ink container 1, which is to be printed, or placed by the like method, in advance on the external surface of the ink container 1, across the area corresponding to the optical storage medium 11. In this case, the pits are formed in the optical storage medium 11, in a straight line, the length of which is proportional to the calculated amount of the ink remaining in the ink container, extending from the maximum level mark toward the minimum level mark, as shown in FIG. 7(*b*), making it possible for a user to visually confirm the calculated amount of the ink in the ink container. Also in this case, when there is no ink left in the ink container, the straight line which the pits form extends from the maximum level mark to the minimum level mark as shown in FIG. 7(*c*).

A point of the writable region of the optical storage medium 11, which has a pit, is different in optical refractive index from a point of the writable region of the optical storage medium 11, which does not have a pit. Therefore, a user can see the line. Incidentally, the straight line which the pits form in accordance with the information in the optical storage medium 11 may be replicated in parallel to make it easier for a user to see the lines, that is, to confirm the amount of the ink remaining in the ink container. With this arrangement, a user can easily confirm the amount of the ink remainder in the ink container even if the ink container 1 is out of the printer.

In the case of this embodiment of the present invention, the optical storage medium 11 is in the bottom wall of the ink container 1. However, the ink container 1 may be devised in structure to place the optical storage medium 11 in the top or side wall of the ink container, in order to make it possible for a user to visually confirm the information in the optical storage medium 11 while the ink container 1 is in a printer. The area of the optical storage medium 11, across which the information is to be written so that it can be visually confirmed, may be the data-writable region 91, or a data-writable region other than the region 91. In the case of the latter, the area from which the information is read with the use of a beam of laser light, and the area across which the information is displayed to be visually confirmed by a user, may be independent from each other.

Also in the case of this embodiment, the optical storage medium 11 is disposed within the recess 1*c* of the ink container 1 to reduce the possibility that the optical storage medium 11 will be soiled or damaged due to the accidental touching of the optical storage medium 11 by a user during the mounting and/or dismounting of the ink container, or the like occasions. Further, the direction in which the ink container 1 is mounted into the head holder, or onto the carriage 4, is perpendicular to the primary scanning direction of the carriage 4. Therefore, should the optical storage medium 11 be accidentally scratched during the mounting or dismounting of the ink container 1, the direction in which the scratches extend is likely to be perpendicular to the line, or lines, of the pits, that is, the optical form of the information, formed in the optical storage medium 11, and such scratches are not likely to damage a large section, or sections, of the information line, or lines. Therefore, in consideration of the possibility that the ink container 1 might be accidentally scratched, the information may be written, while being distributed with the use of one of the error correction technologies, for example, the cross interleave read SOLOMON coding, and read thereby, so that the information can be compensated for, for the damaged line, or lines, of the pits. Also in the case of this embodiment, dust and/or the splashes of liquid from the recording head 2 may adhere to the optical storage medium 11, soiling or damaging thereby the recording surface thereof. Thus, in consideration of the reading errors which might occur due to this soiling and/or damaging of the recording surface, the information may be written in entirety across two or more areas so that should it become impossible for the information in one area of the optical storage medium 11 to be read, the same information in another area can be read in entirety.

Further, the reflective film 101 of the above described optical storage medium 11 is an aluminum film formed by vapor deposition, and the materials for the colored film 102 and substrate 103 are copper phthalocyanine and polycarbonate, respectively. However, other substances may be chosen as the materials for the optical storage mediums 11, as long as an optical storage medium resulting from the chosen materials is the same in properties to the optical storage medium 11 in this embodiment, in that it changes in optical properties as it is exposed to a beam of light such as laser light.

The optical storage medium 11 in this embodiment is of a type in which as new information is written into the optical storage medium 11, it is to be added to the information therein. However, the optical storage medium 11 may be structured so that as new information is written into the optical storage medium 11, the information therein is replaced by the new information, which is obvious.

(Embodiment 2)

In the case of the above described first embodiment of the present invention, the ink container and recording head are structurally independent from each other. However, the recording head may be all integral part of the ink container. The optical storage medium 11 in this second embodiment is the same in basic structure as that in the above described first embodiment. Therefore, the components of the optical storage medium 11 in this embodiment identical to the counterparts in the first embodiment will be given the identical referential symbols as those given to the counterparts, one for one, and will not be described at this time.

Figure 8:
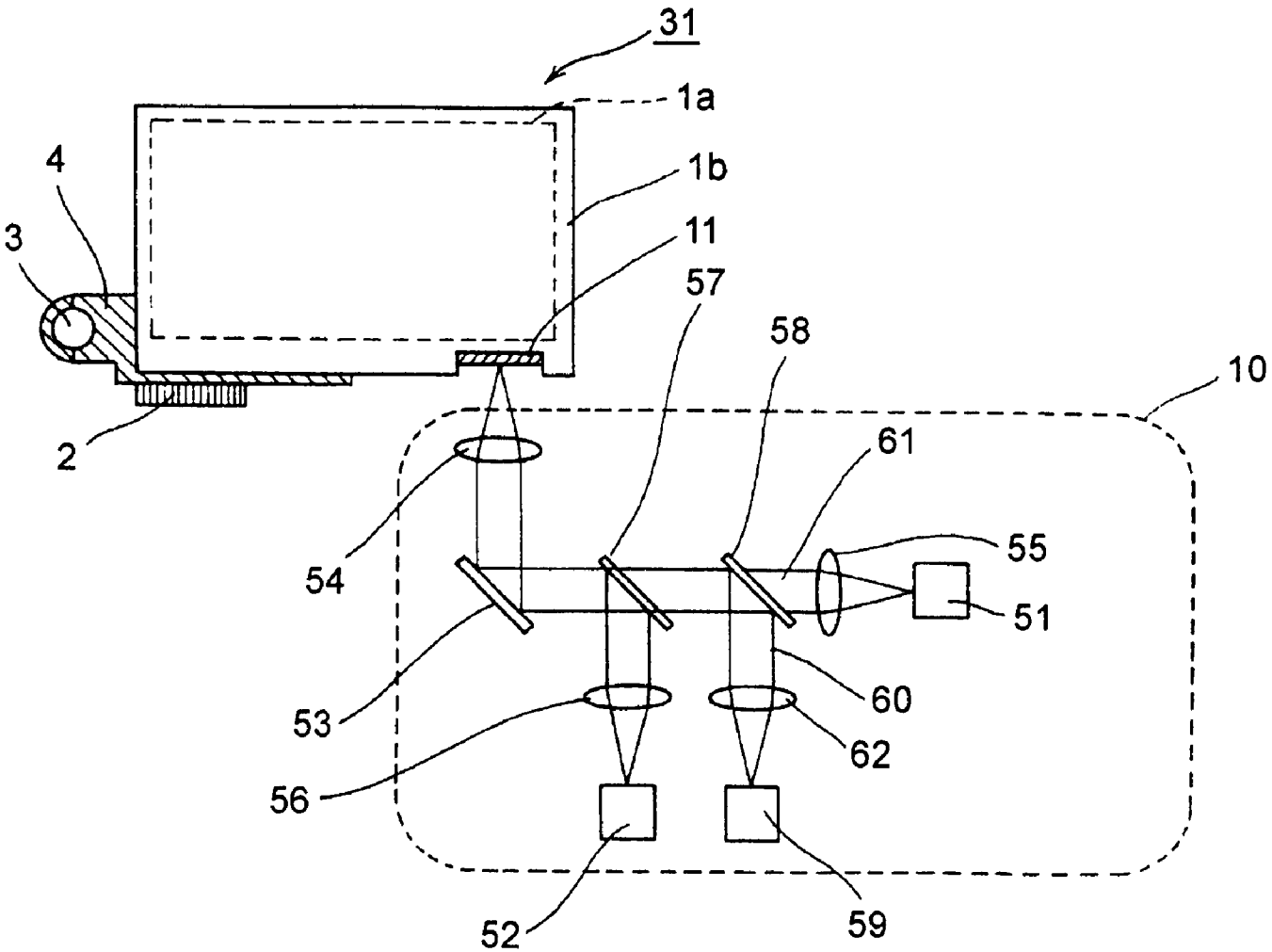
FIG. 8 is a schematic side view of the essential portion of the printer in the second embodiment of the present invention.

Referring to FIG. 8, the recording head 2 of the ink container 31 in this embodiment is an integral part of the ink container proper 1*a* of the ink container 31, remaining therefore connected to the ink container proper 1*a*. Therefore, as the ink container 31 is replaced by a user, the recording head 2 is also replaced. Generally speaking, each ink container is different from another ink container in terms of ink ejection properties, for example, amount by which ink is ejected per ejection, speed at which ink is ejected, etc. This difference occurs during ink container manufacture. In consideration of this fact, the information regarding each ink container, in particular, the ink ejection properties of the recording head 2, for example, amount by which ink is ejected by the recording head per ejection, speed at which ink is ejected by the recording head 2, etc., is desired to be measured and written into the above described optical storage medium 11 during the manufacture of the ink container, so that as the ink container is mounted into a printer, the information can be read by the printer in order to make its image forming operation reflect the information to improve the level of quality at which an image is formed. With this arrangement, an image much better in quality than that formable by the printer in the preceding embodiment can be formed.

(Embodiment 3)

Figure 11:
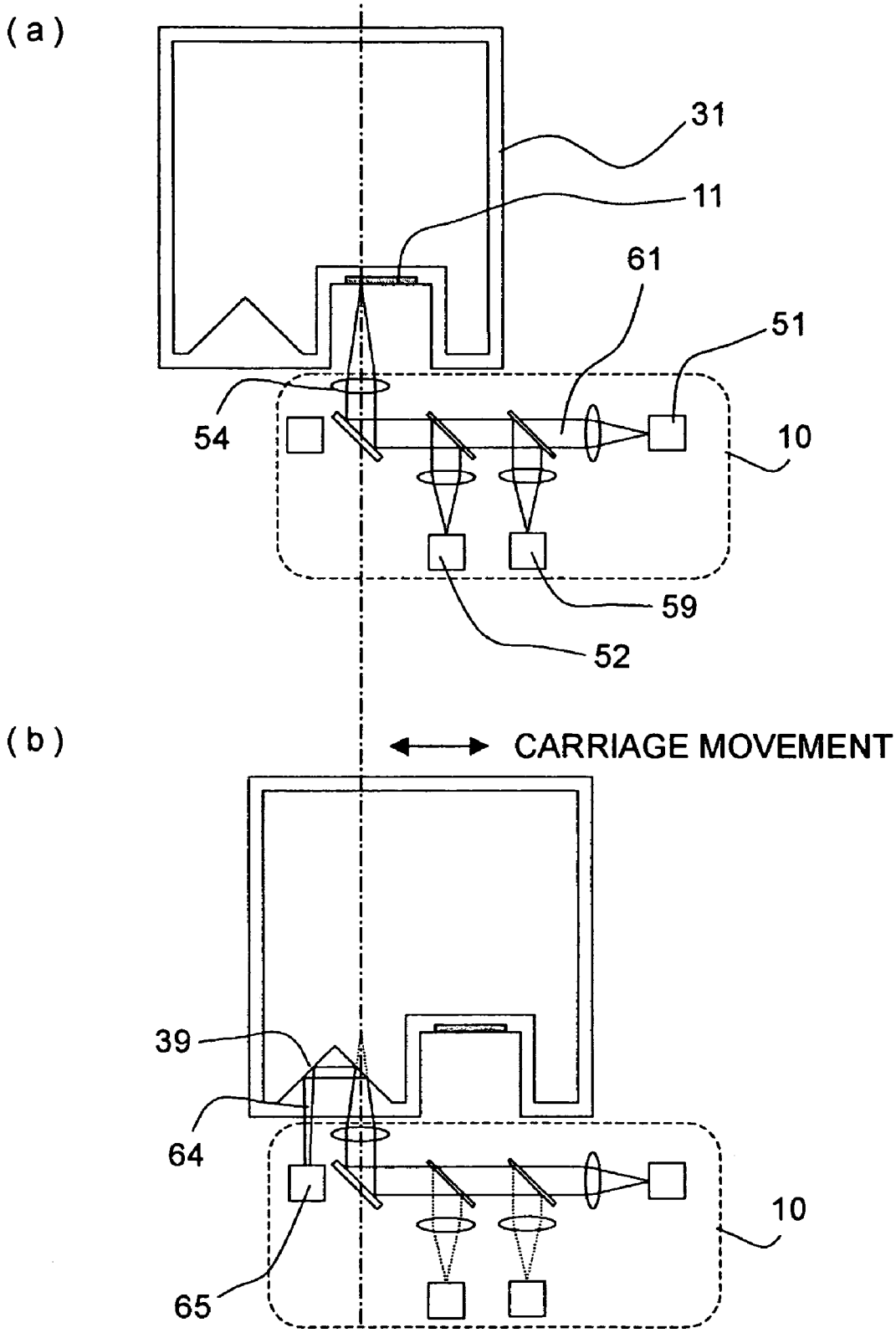
FIG. 11 is a schematic side view of the essential portion of the printer in the third embodiment of the present invention.

The ink storage portion of the above described ink container 1 in the first embodiment may be provided with a prism. FIG. 11 is a schematic sectional view of the ink container in this embodiment. The optical portion of a printer is disposed so that it does not move in the primary scanning direction of the carriage. FIG. 11(*a*) shows the relationship between the ink container 1 and the optical portion 10 of the printer when the optical storage medium 11 is directly above the object lens 54 of the optical portion 10 (above recording paper), whereas FIG. 11(*b*) shows the relationship after the carriage has been moved to move the ink container 1 in order to place the prism 39 directly above the object lens 54.

As the amount of the ink in the ink storage portion reduces, the prism 39, with which the ink storage portion is provided, changes in the refractive index of its reflective surfaces, making it possible to optically detect the presence or absence of ink in the ink storage portion.

In the case of this structural arrangement, a single optical system is used to write information into the optical storage medium 11, to read the information from the optical storage medium 11, and also to detect the amount of the ink remaining in the ink storage portion, that is, to detect the refractive index of the prism 39. Therefore, the ink container 31 is structured so that the vertical (in FIG. 11) distance between the optical storage medium 11 and the object lens 54 of the optical portion, becomes different from the vertical distance between a given point of the reflective surfaces of the prism 39 and the object lens 54 of the optical portion. Referring to FIG. 11(*a*), after being condensed by the object lens 54, the laser light is focused on the optical storage medium 11 to write information in the optical storage medium 11, or to read the information therefrom. Referring to FIG. 11(*b*), where the laser light hits the reflective surface of the prism 39, the laser light has not completely converged, forming therefore a light spot of a certain size. Therefore, even if a small amount of ink had adhered to the reflective surface of the prism 39, the substantial portion of the laser light 64 is reflected by the reflective surface of the prism 39, in spite of the presence of ink spots on the reflective surface, reaching the ink remainder amount detection sensor 65, making it therefore possible to detect the presence or absence of ink in the ink storage portion, provided that the size of the light spot formed by the laser light where the laser light hits the reflective surface of the prism 39 is substantial. In this case, in order to compensate for the errors in the calculated amount of the ink remainder, the methods, in which the total amount of the ink ejected, in the form of an ink droplet, from the recording head 2 is counted, and the amount of the ink remaining in the ink container 1, which is calculated on the main assembly side of an ink jet recording apparatus, based on the counted total amount of the ejected ink, is displayed in the analog fashion, may be combined with the method, in this embodiment, in which the presence or absence of ink in the ink storage portion is detected by providing the ink container 1 with a prism such as the above described prism 39. With such combination, the displayed amount of the ink in the ink container is far more accurate than the amount displayed in the preceding embodiments.

(Embodiment 4)

In the case of the above described first and second embodiments of the present invention, the ink container is mounted on the carriage of a printer, being therefore movable within the printer. However, the ink container may be structured so that it is stationarily fixed in a printer.

Providing a printer with an ink container of a large capacity makes it necessary to provide the printer with a carriage capable of holding the ink container of a large capacity, making it therefore necessary to increase the printer in overall size. This dilemma can be eliminated by designing a printer so that an ink container can be made structurally independent from a recording head to make it possible to place an ink container of a large capacity within the printer, at a location other than on the carriage. This design for a printer makes it unnecessary to increase a printer in overall size in order to provide the printer with an ink container of a large capacity, or to reduce, in overall size, a printer employing an ink container of a large size. In the case of this structural arrangement, an ink container is not moved in a printer; the printer is to be provided with a mechanism for moving the optical portion of the printer relative to the optical storage medium of the ink container, so that the information can be written into, or read from, the optical storage medium of the stationary ink container. The mechanism for moving the optical portion of the printer main assembly can be devised so that only a single optical portion is required to write information into, or read information from, each of the optical storage mediums of the multiple ink containers disposed in parallel in the printer main assembly.

While the invention has been described with reference to the structures disclosed herein, it is not confined to the details set forth, and this application is intended to cover such modifications or changes as may come within the purposes of the improvements or the scope of the following claims.

What is claimed is:

1. A liquid container containing ink, which is detachably mountable to a carriage, the improvement residing in the provision of an optical medium to which information is writable using visible light and from which the information is readable, wherein said optical medium includes a substrate and a coloring matter layer laminated thereon, and said substrate is integral with said liquid container.

2. A liquid container containing ink, which is detachably mountable to a carriage, the improvement residing in the provision of an optical medium to which information is writable using visible light and from which the information is readable, wherein said liquid container is made of amorphous cyclic polyolefin resin material.

3. A liquid container containing ink, which is detachably mountable to a carriage, the improvement residing in the provision of an optical medium to which information is writable using visible light and from which the information is readable, wherein said optical medium includes a plurality of the areas on which the same information is written, respectively.

4. A liquid container containing ink, which is detachably mountable to a carriage, the improvement residing in the provision of an optical medium to which information is writable using visible light and from which the information is readable, wherein said optical medium includes a first area in which a main part of the information is written and the second area in which a subordinate part of the information indicative of a position at which the main information is written.

5. A liquid container containing ink, which is detachably mountable to a carriage, the improvement residing in the provision of an optical medium to which information is writable using visible light and from which the information is readable, wherein further comprising a prism in a liquid accommodating portion for accommodating the liquid, and wherein the reflecting surface of the prism is deviated from said optical medium with respect to a direction of height of said liquid container.

* * * * *